US010226946B2

(12) United States Patent
Kodama et al.

(10) Patent No.: US 10,226,946 B2
(45) Date of Patent: Mar. 12, 2019

(54) POST-PROCESSING DEVICE AND RECORDING APPARATUS

(71) Applicant: SEIKO EPSON CORPORATION, Tokyo (JP)

(72) Inventors: Hidetoshi Kodama, Nagano (JP); Yutaro Harada, Nagano (JP); Hirohisa Adachi, Matsukawa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/642,600

(22) Filed: Jul. 6, 2017

(65) Prior Publication Data

US 2018/0015740 A1 Jan. 18, 2018

(30) Foreign Application Priority Data

Jul. 13, 2016 (JP) ..... 2016-138256

(51) Int. Cl.
*B41J 11/00* (2006.01)
*B41J 13/10* (2006.01)
(Continued)

(52) U.S. Cl.
CPC ..... *B41J 11/0015* (2013.01); *B41J 11/0005* (2013.01); *B41J 13/106* (2013.01); *B41J 29/377* (2013.01); *B65H 29/247* (2013.01); *B65H 29/70* (2013.01); *B65H 31/02* (2013.01); *G03G 15/6576* (2013.01); *B65H 2220/11* (2013.01); *B65H 2301/4212* (2013.01); *B65H 2301/4213* (2013.01); *B65H 2301/5122* (2013.01); *B65H 2301/51214* (2013.01); *B65H 2405/1412* (2013.01); *B65H 2406/1222* (2013.01);
(Continued)

(58) Field of Classification Search
CPC .. B41J 11/0015; B41J 11/0005; B41J 13/106; B41J 29/377; B41J 13/226; B65H 5/062; B65H 29/125; B65H 2515/34; B65H 2220/11; B65H 2301/4213; B65H 2513/512; B65H 29/247; B65H 29/70; B65H 31/02; G03G 15/6576; G03G 2215/00662; G03G 15/6567
USPC ..... 347/16, 101, 102, 104; 271/220; 270/58.08
See application file for complete search history.

(56) References Cited

U.S. PATENT DOCUMENTS 6,308,026 B1 10/2001 Kouchi
6,460,687 B1 10/2002 Escobedo et al.
(Continued)

FOREIGN PATENT DOCUMENTS

JP 2003-002513 A 1/2003
JP 2003-002516 A 1/2003
(Continued)

OTHER PUBLICATIONS

The Extended European Search Report for the corresponding European Patent Application No. 17180437.0 dated Dec. 8, 2017.

*Primary Examiner* — Jannelle M Lebron

(57) ABSTRACT

A post-processing device is provided with a post-processing unit which performs post-processing of a recording medium on which recording is performed, a transport path through which the recording medium is transported, or a deformation suppressing unit which suppresses deformation of the recording medium on a mounting unit on which the recording medium is mounted, in which the deformation suppressing unit is controlled based on a predetermined parameter related to recording processing with respect to the recording medium.

10 Claims, 10 Drawing Sheets

(51) Int. Cl.

| | |
|---|---|
| ***B41J 29/377*** | (2006.01) |
| ***B65H 29/24*** | (2006.01) |
| ***B65H 29/70*** | (2006.01) |
| ***B65H 31/02*** | (2006.01) |
| *G03G 15/00* | (2006.01) |

(52) U.S. Cl.

CPC .. *B65H 2515/342* (2013.01); *B65H 2515/805* (2013.01); *B65H 2801/27* (2013.01); *G03G 15/6567* (2013.01); *G03G 2215/00662* (2013.01)

(56) References Cited

U.S. PATENT DOCUMENTS

| | | | |
|---|---|---|---|
| 2003/0006543 | A1 | 1/2003 | Tamura et al. |
| 2007/0048048 | A1 | 3/2007 | Kougami et al. |
| 2008/0224386 | A1 | 9/2008 | Kunieda et al. |
| 2009/0184466 | A1 | 7/2009 | Maeda et al. |
| 2010/0002037 | A1 | 1/2010 | Kusuhata |
| 2011/0140343 | A1 | 6/2011 | Tanaka et al. |
| 2011/0229240 | A1 | 9/2011 | Shibayama |
| 2013/0004652 | A1 | 1/2013 | Furukawa |
| 2014/0062005 | A1 | 3/2014 | Suzuki et al. |
| 2014/0354728 | A1 | 12/2014 | Murata et al. |
| 2015/0116411 | A1 | 4/2015 | Suzuki |
| 2015/0151944 | A1 | 6/2015 | Shirasaki et al. |
| 2015/0266320 | A1 | 9/2015 | Kokura |
| 2016/0023858 | A1 | 1/2016 | Mizuno |
| 2016/0031234 | A1 | 2/2016 | Segawa |

FOREIGN PATENT DOCUMENTS

| | | | |
|---|---|---|---|
| JP | 2003-292227 | A | 10/2003 |
| JP | 2013-006322 | A | 1/2013 |
| JP | 2014-162565 | A | 9/2014 |
| JP | 2015-107840 | A | 6/2015 |
| JP | 2015-107848 | A | 6/2015 |
| JP | 2015-174331 | A | 10/2015 |

POST-PROCESSING DEVICE AND RECORDING APPARATUS

BACKGROUND

1. Technical Field

The present invention relates to a post-processing device and a recording apparatus provided with the post-processing device.

2. Related Art

In the related art, a post-processing device provided with a mounted sheet processing unit which performs post-processing such as stapling or shift processing with respect to sheets on which images are formed has been known (for example, refer to JP-A-2015-107840). In the post-processing device, post-processing is performed in a state in which a plurality of sheets on which images are formed are mounted on a processing tray.

In addition, as an apparatus for forming an image on a sheet, for example, an ink jet printer provided with a recording head which ejects ink which is liquid, as ink droplets, or the like, has been known.

Meanwhile, in a case of forming an image using an ink jet printer, there is a case in which a sheet on which the image is formed is curled (part of sheet is deformed by being bent, or the like) along with absorbing of ink (moisture), drying of ink, or the like.

For this reason, in a case of sequentially mounting sheets on which images are formed by using the ink jet printer on a processing tray of a post-processing device, a sheet transported later is caught on a curled portion of a sheet which is mounted earlier when a degree of curling of the sheet mounted earlier is high, and there has been a problem in that sheets are in a non-aligned state, or a transport failure occurs.

SUMMARY

The invention can be realized in the following application examples or aspects.

APPLICATION EXAMPLE 1

According to this application example, there is provided a post-processing device which is provided with a post-processing unit which performs post-processing of a recording medium on which recording is performed by using water-based ink, a mounting unit on which the recording medium subjected to post-processing in the post-processing unit is mounted, a deformation suppressing unit which suppresses deformation of the recording medium caused by a predetermined parameter related to recording processing with respect to the recording medium, in the mounting unit, and a control unit which controls the deformation suppressing unit, in which the control unit controls the deformation suppressing unit based on the predetermined parameter, and information related to recording data for performing recording on the recording medium is included in the predetermined parameter.

There is a case in which a recording medium on which recording is performed is deformed (for example, curled) in a transport path through which the recording medium is transported or in a mounting unit on which the recording medium is mounted due to an influence of a recording material (water-based ink). A degree of the deformation (amount of deformation or stress due to deformation) is not constant, and is different depending on various parameters (for example, material of recording medium, material for recording, image to be recorded, recording environment, or the like) related to recording processing with respect to a recording medium. According to the application example, since the deformation suppressing unit is controlled based on a predetermined parameter (in particular, information related to recording data for performing recording on recording medium) related to recording processing with respect to a recording medium, it is possible to further appropriately suppress deformation of a recording medium.

That is, there is a case in which a degree of deformation (amount of deformation or stress due to deformation) of a recording medium after recording or drying is different depending on the recording data (for example, recording region or recording density) for performing recording on a recording medium. According to the application example, since information related to the recording data for performing recording on a recording medium is included in a parameter, and suppressing intensity of a deformation suppressing unit for suppressing deformation of a recording medium is controlled based on the parameter, it is possible to further appropriately suppress deformation of the recording medium.

Water-based ink has a merit of having only a slight odor compared to oil-based ink, and in which a state in which recording with respect to one surface of a recording medium is visible from the other surface (so-called strike through) rarely occurs; however, there is also a demerit that a degree of deformation of a recording medium after recording or drying is high compared to recording in which oil-based ink is used. According to the application example, it is possible to perform processing after recording in a state in which deformation of a recording medium is effectively suppressed further with respect to the recording medium on which recording is performed by using water-based ink.

APPLICATION EXAMPLE 2

In the post-processing device according to the application example, the deformation suppressing unit may suppress deformation of the recording medium using a wind pressure.

According to the application example, it is possible to effectively suppress deformation of the recording medium using a wind pressure.

APPLICATION EXAMPLE 3

In the post-processing device according to the application example, the deformation suppressing unit may include three air blowers which face a mounting face, the three air blowers may be disposed in a line in a direction orthogonal to a direction in which a medium subjected to post-processing in the post-processing unit is discharged to the mounting unit, one air blower among the three air blowers may be disposed at a center of the mounting unit with respect to the orthogonal direction, and may be disposed by being interposed between other air blowers with respect to the orthogonal direction, and the control unit may control the air blowers which are operated, according to the difference in moisture between the inside and outside of the recording medium, and the surface of the recording medium which faces the mounting unit.

According to the application example, it is possible to appropriately control the position for blowing the air according to the orientation of a protruded shape of a medium.

APPLICATION EXAMPLE 4

In the post-processing device according to the application example, the control unit may control the air blower which is disposed at the center to blow air in a case in which the difference in moisture between the inside and outside is a predetermined value or more, and a case in which the surface of the recording medium with large amount of moisture does not face the mounting unit, may control the other air blower to blow air in a case in which the difference in moisture between the inside and outside is a predetermined value or more, and a case in which the surface of the recording medium with large moisture faces the mounting unit, and may control the air blowers so as not to blow air in a case in which the difference in moisture between the inside and outside is less than a predetermined value.

According to the application example, since the air blower disposed at the center blows air when a recording medium mounted on the mounting unit is in a protruded shape, and other air blowers disposed at end portions blow air when the recording medium mounted on the mounting unit is in a recessed shape, it is possible to blow air to an appropriate position based on a curled shape of the recording medium. In addition, since air blowing is not performed in a case of determining that a recording medium is not curled, it also contributes to energy saving.

APPLICATION EXAMPLE 5

In the post-processing device according to the application example, the water-based ink may contain water of 50 weight % or more, and may include a water soluble organic solvent, surfactant, and pigment.

It is preferable that water-based ink which is used contain water of 50 weight % or more, and include a water soluble organic solvent, surfactant, and pigment, like the post-processing device in the application example.

APPLICATION EXAMPLE 6

In the post-processing device according to the application example, physical property information of the recording medium, information on recording environment in which recording is performed on the recording medium, or a lapsed time after performing recording on the recording medium may be included in the predetermined parameter.

There is a case in which a degree of deformation (amount of deformation or stress due to deformation) of a recording medium after recording or drying is different depending on a physical property of the recording medium. According to the application example, since suppressing intensity of the deformation suppressing unit which suppresses deformation of a recording medium is controlled based on a predetermined parameter in which physical property information of a recording medium is included, it is possible to further appropriately suppress deformation of the recording medium.

There is a case in which a degree of deformation (amount of deformation or stress due to deformation) of a recording medium after recording or drying is different depending on an environment (for example, temperature or humidity) in which recording is performed on a recording medium. According to the application example, since suppressing intensity of the deformation suppressing unit which suppresses deformation of a recording medium is controlled based on a predetermined parameter in which information on recording environment in which recording is performed on the recording medium is included, it is possible to further appropriately suppress deformation of the recording medium.

There is a case in which a degree of deformation (amount of deformation or stress due to deformation) of a recording medium after recording or drying is different depending on a lapsed time after performing recording on a recording medium. According to the application example, since suppressing intensity of the deformation suppressing unit which suppresses deformation of a recording medium is controlled based on a predetermined parameter in which a lapsed time after performing recording on the recording medium is included, it is possible to further appropriately suppress deformation of the recording medium.

APPLICATION EXAMPLE 7

In the post-processing device according to the application example, an intermediate processing unit which performs intermediate processing, and a finishing unit which performs a finishing treatment may be provided as the post-processing unit, the intermediate processing unit may perform reversal processing or drying processing of the recording medium as the intermediate processing, and the finishing unit may perform stapling, punching, or sorting as the finishing treatment with respect to the plurality of recording media on which the intermediate processing is completed.

According to the application example, the intermediate processing unit which performs intermediate processing, and the finishing unit which performs finishing treatment are provided as the post-processing unit, the intermediate processing unit performs reversal processing or drying processing of a recording medium as the intermediate processing, and the finishing unit performs stapling, punching, or sorting as the finishing treatment with respect to the plurality of recording media on which the intermediate processing is completed. That is, it is possible to perform a plurality of processes with respect to a recording medium on which recording is performed. In addition, since deformation of a recording medium is further appropriately suppressed, it is possible to suppress an occurrence of a failure such as jamming even in the post-processing device which performs a plurality of processes.

APPLICATION EXAMPLE 8

According to this application example, there is provided a recording apparatus which includes a recording head which performs recording by applying water-based ink to a recording medium, a post-processing unit which performs post-processing of the recording medium on which recording is performed, a mounting unit on which the recording medium subjected to post-processing in the post-processing unit is mounted, a deformation suppressing unit which suppresses deformation of the recording medium caused by a predetermined parameter related to recording processing with respect to the recording medium, in the mounting unit, and a control unit which controls the deformation suppressing unit, in which the control unit controls the deformation suppressing unit based on the predetermined parameter, and information related to recording data for performing recording on the recording medium is included in the predetermined parameter.

According to the application example, it is possible to perform recording which is subjected to post-processing in a state in which deformation of a recording medium after recording is further appropriately suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which the invention is embodied will be described with reference to drawings. The following is an embodiment of the invention, and does not limit the invention. In each of the following figures, there is a case in which scales different from the actual scales are described in order to make descriptions easy to understand.

Embodiment 1

Recording Apparatus

Figure 1:
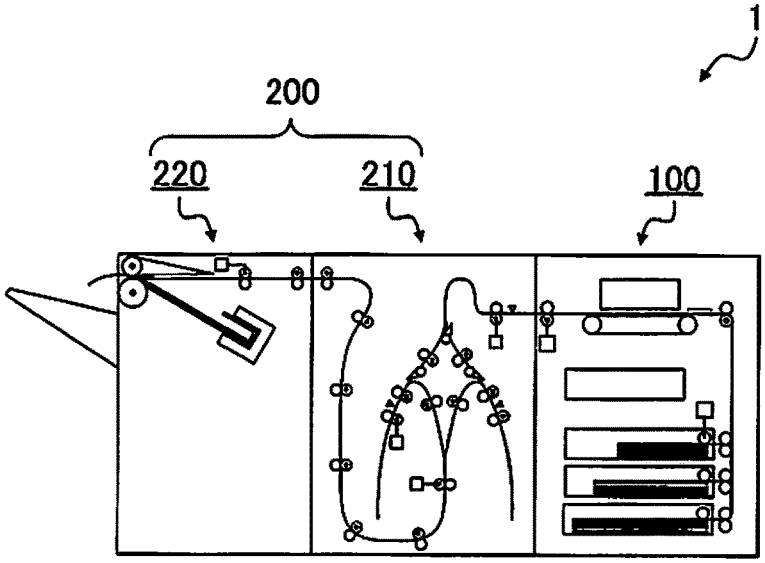
FIG. 1 is a schematic view which illustrates a configuration of a recording apparatus according to embodiment 1.

FIG. 1 is a schematic view which illustrates a configuration of a recording apparatus 1 according to embodiment 1.

The recording apparatus 1 is configured of an ink jet printer 100 (hereinafter, referred to as printer 100) which performs recording (printing) on a recording medium 12 such as a printing sheet, a post-processing device 200, and the like.

The post-processing device 200 is provided with a post-processing unit which performs post-processing of the recording medium 12 on which recording is performed. In addition, the post-processing device 200 is provided with the intermediate processing unit which performs intermediate processing, and the finishing unit which performs the finishing treatment as the post-processing unit. Specifically, the post-processing device 200 is provided with an intermediate processing unit which performs intermediate processing, and a finishing unit which performs a finishing treatment. Specifically, the post-processing device 200 is configured of a reversal device 210 provided with reversal transport path 18 as an intermediate processing unit which performs reversal processing (turning over) of the recording medium 12 on which recording is performed by the printer 100 as the intermediate processing in post-processing with respect to the recording medium 12 on which recording is performed, a stapling device 220 provided with a stapling unit 36 as the finishing unit which stacks the recording medium 12 subjected to reversal processing, and performs stapling in a predetermined unit, as the finishing treatment after the intermediate processing, and the like.

The "post-processing device" in the aspect refers to a device which performs post-processing with respect to the recording medium 12 on which recording is performed, and the reversal device 210 and the stapling device 220 correspond to the post-processing device in the example in the embodiment; however, the post-processing device is not limited to these, and may be a device which performs processing of inserting a leaflet into each predetermined page, and perform stacking, punching for making a hole, separating a book (sorting) into predetermined units, stacking by folding a medium at a predetermined position, and the like.

Figure 2:
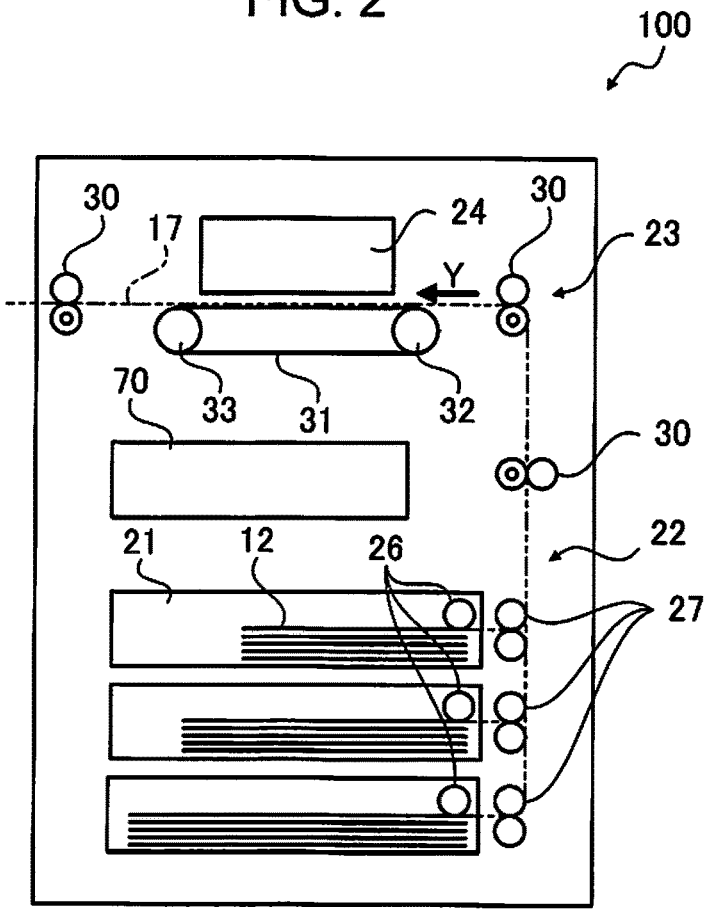
FIG. 2 is a schematic view which illustrates a configuration of a printer.
Figure 3:
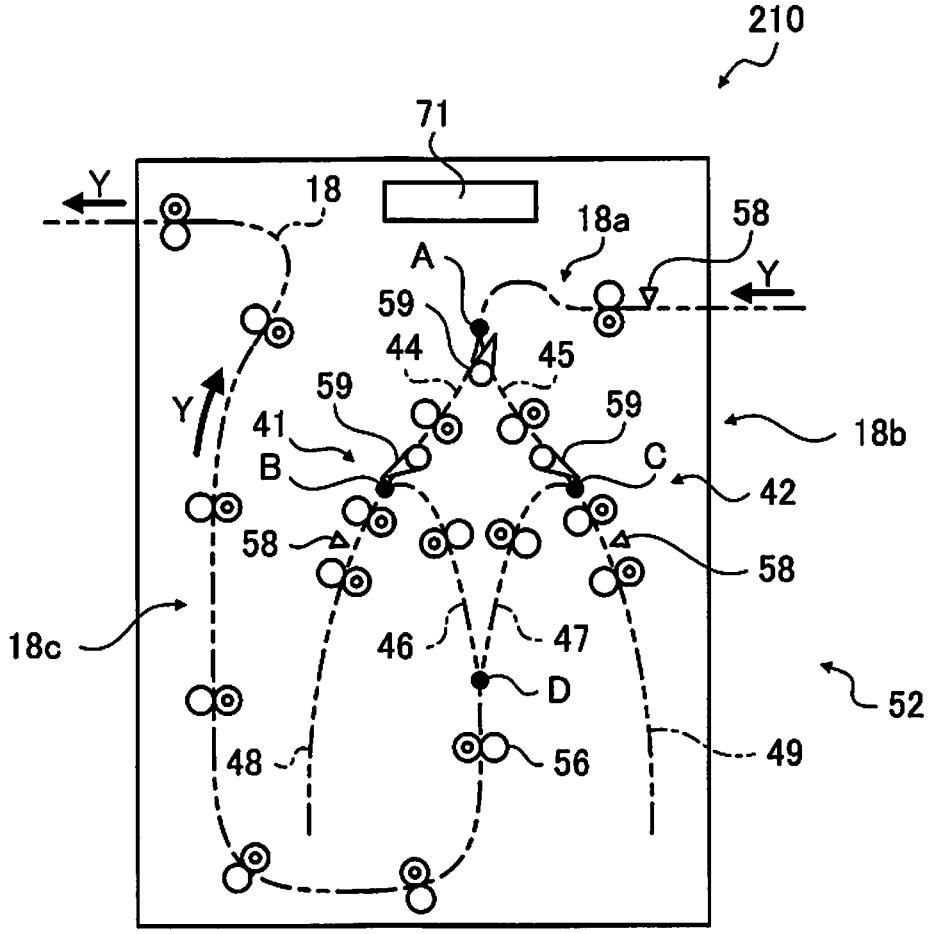
FIG. 3 is a schematic view which illustrates a configuration of a reversal device (post-processing device).
Figure 4:
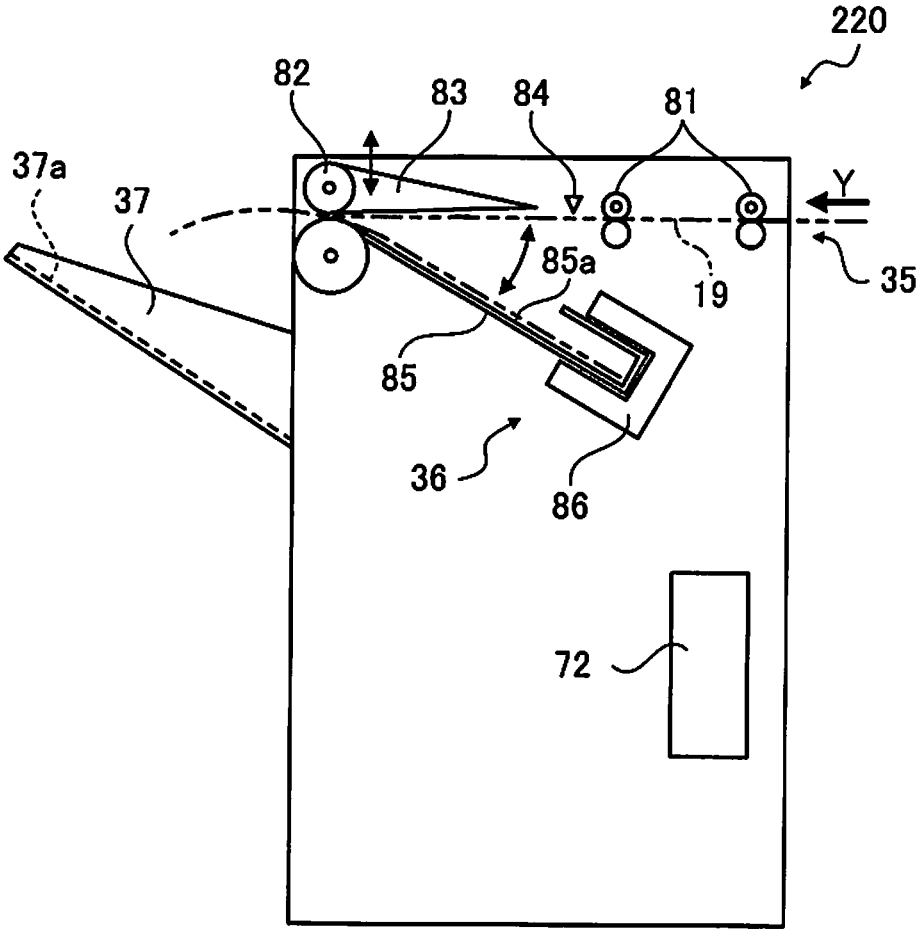
FIG. 4 is a schematic view which illustrates a configuration of a stapling device (post-processing device).

FIG. 2 is a schematic view which illustrates a configuration of the printer 100, FIG. 3 is a schematic view which illustrates a configuration of the reversal device 210, and FIG. 4 is a schematic view which illustrates a configuration of the stapling device 220.

The printer 100 is provided with a printer transport path 17, and the reversal device 210 is provided with a reversal transport path 18. In addition, the stapling device 220 is provided with a stapler transport path 19. A transport path which is denoted by a two-dot dashed line which goes from the printer 100 on the upstream side in the transport direction Y to the stapling device 220 through the reversal device 210 is configured by the printer transport path 17, the reversal transport path 18, and the stapler transport path 19.

Printer

As illustrated in FIG. 2, the printer 100 is provided with a cassette 21, a feeding unit 22, a printer transport unit 23, a recording unit 24, a printer control unit 70, and the like.

The cassette 21 is an accommodating unit which can accommodate the recording medium 12 in a stacked state, and at least one cassette (three in FIG. 2) is detachably provided in the printer 100.

The feeding unit 22 feeds the recording medium 12 which is accommodated in the cassette 21 to the printer transport unit 23. The feeding unit 22 is provided with a pickup roller 26 which sends the uppermost recording medium 12 among the recording media 12 which are disposed in the cassette 21 in a stacked state, and a pair of separating rollers 27 which separates the recording medium 12 sent by the pickup roller 26 sheet by sheet. The feeding unit 22 is further provided with a feeding motor (not illustrated) for driving the pickup roller 26 in a rotating manner.

The printer transport unit 23 transports the fed recording medium 12 to the recording unit 24, and sends the recording medium 12 on which recording is completed to the reversal device 210.

The printer transport unit 23 is provided with at least one pair of (three in FIG. 2) transport rollers 30 which transports the recording medium 12 along the printer transport path 17 by rotating along with driving of the transport motor (not illustrated). In addition, a driving pulley 32 and a driven pulley 33 over which an endless transport belt 31 is stretched are provided at a position located along the printer transport path 17. The recording medium 12 is transported along with the rotation of the transport belt 31 in a state of being electrostatically adsorbed to a support face (outer peripheral face) of the transport belt 31.

The recording unit 24 is provided with a tank (not illustrated) for accommodating liquid (hereinafter, referred to as ink) as a recording material for performing recording on the recording medium 12, or an ink ejecting head (not illustrated) for ejecting ink to the recording medium 12. The ink ejecting head is provided at a position facing the transport belt 31 across the printer transport path 17. The recording unit 24 performs recording (formation of image based on recording data) on the recording medium 12 which is transported by being supported by the transport belt 31, by ejecting and attaching ink based on recording data. The recording unit 24 (ink ejecting head) in the embodiment is a so-called line head which can eject ink at the same time over the width direction which intersects (for example, orthogonal) the transport direction Y of the recording medium 12.

Recording data is data for causing the printer 100 to execute recording which is generated based on image data (text data or image data) which is recorded on the recording medium 12.

The printer control unit 70 is a personal computer, for example, which is provided with an input unit, a display unit, a storage unit (not illustrated), and the like, has a function for enabling communication between a reversal control unit 71 and a stapler control unit 72 which will be described later, and performs a driving control of the feeding unit 22, the printer transport unit 23, the recording unit 24, and the like, by being linked thereto.

Post-Processing Device (Reversal Device)

As illustrated in FIG. 3, the reversal device 210 is provided with a first reversal unit 41, a second reversal unit 42, a reversal transport unit 52, the reversal control unit 71, and the like, and configures the reversal transport path 18 as the post-processing unit (intermediate processing unit) which reverses the recording medium 12 (transports by turning recording medium over).

The reversal transport unit 52 includes a pair of transport rollers 56, a sensor 58, a guide flap 59, and the like.

The reversal transport path 18 is configured of a pre-reversal path 18*a*, a reversal path 18*b*, and a post-reversal path 18*c*.

An upstream end of the pre-reversal path 18*a* is connected to the printer transport path 17, and the recording medium 12 is introduced thereto. A junction A (upstream end of reversal path 18*b*) is connected to a downstream end of the pre-reversal path 18*a* is connected with a.

The reversal path 18*b* is configured of a first branch path 44, a second branch path 45, a first confluence path 46, a second confluence path 47, a first reversal path 48, and a second reversal path 49. The first branch path 44 is a path from the junction A to a first connecting point B. The second branch path 45 is a path from the junction A to a second connecting point C. The first confluence path 46 is a path from the first connecting point B to a junction D. The second confluence path 47 is a path from the second connecting point C to the junction D. The first reversal path 48 is a path which is continuous up to the first connecting point B. The second reversal path 49 is a path which is continuous up to the second connecting point C.

An upstream end of the post-reversal path 18*c* is connected to the junction D (downstream end of reversal path 18*b*), and the recording medium 12 which is reversed on the reversal path 18*b* is introduced thereto. The downstream end of the post-reversal path 18*c* is connected to the stapler transport path 19 of the stapling device 220.

The pair of transport rollers 56 is provided in each portion of the reversal transport path 18, and is driven by a transport motor (not illustrated).

The sensors 58 are provided on the pre-reversal path 18*a*, the first reversal path 48, and the second reversal path 49, and detect the recording medium 12 transported along each path.

The guide flaps 59 are provided at the junction A, the first connecting point B, and the second connecting point C, and guide a transport direction of the recording medium 12 which is transported to each point. The guide flap 59 rotates, using a solenoid (not illustrated), and guides a transport direction of the recording medium 12 at the junction of the transport path.

Driving of the reversal transport unit 52 (pair of transport rollers 56, sensor 58, guide flap 59, and the like) is controlled by the reversal control unit 71, and the reversal transport unit transports the recording medium 12 along the reversal transport path 18.

The first reversal unit 41 is configured of the first branch path 44, the first reversal path 48, the first confluence path 46, and the pair of transport rollers 56, the guide flap 59, the sensor 58, and the like, which are included in these paths.

In addition, the second reversal unit 42 is configured of the second branch path 45, the second reversal path 49, the second confluence path 47, and the pair of transport rollers 56, the guide flap 59, the sensor 58, and the like, which are included in these paths.

The reversal control unit 71 has a function of enabling communication between the printer control unit 70 and the stapler control unit 72 which will be described later, controls driving of the pair of transport rollers 56, the sensor 58, and the guide flap 59 by being linked, and performs reversal processing of the recording medium 12.

Specifically, the reversal control unit 71 continuously performs reversal processing of the recording medium 12 by repeating an operation of reversing the recording medium 12 which is introduced to the pre-reversal path 18*a* using the first reversal unit 41 (operation of transporting recording medium from first branch path 44 to the post-reversal path 18*c* through first confluence path 46 and first reversal path 48), and an operation of reversing the recording medium using the second reversal unit 42 (operation of transporting recording medium 12 introduced to the pre-reversal path 18*a* from second confluence path 45 to the post-reversal path 18*c* through second reversal path 49 and second confluence path 47).

Post-Processing Device (Stapling Device)

The stapling device 220 is a device which sequentially stacks the recording media 12 which are reversed by the reversal device 210, and discharges the recording media by performing stapling on the recording media in predetermined units, and as illustrated in FIG. 4, the stapling device is provided with a stapler transport unit 35, a stapling unit 36 as the post-processing unit (finishing treatment unit), a stacker 37, a stapler control unit 72, and the like.

The stapler transport unit 35 transports the recording medium 12 introduced from the reversal device 210 to the stapling unit 36, and sends the recording media 12 on which stapling has been completed in the stapling unit 36 to the stacker 37. The stapler transport unit 35 is provided with a pair of transport rollers 81 and 82, a guide flap 83, a sensor 84, and the like.

The pair of transport rollers 81 and 82 transports the recording medium 12 into the stapling device 220 along the stapler transport path 19 by rotating with driving of a transport motor (not illustrated). When the sensor 84 detects a terminal end of the recording medium 12 which is transported, the guide flap 83 guides a terminal end side of the recording medium 12 in a direction of the stapling unit 36, and subsequently opens a nip of the pair of transport rollers 82. The recording medium 12 moves (slides down) toward the stapling unit 36 which is provided in the lower part due to its own weight. In addition, a configuration may be adopted in which the recording medium 12 is assisted so as to easily move to the stapling unit 36 by reversing the pair of transport rollers 82, when the recording medium 12 moves (slides down) toward the stapling unit 36 due to its own weight.

The stapling unit 36 is provided with a tray 85, a stapler 86, or the like. The tray 85 is provided in an inclined manner so as to be declined from the pair of transport rollers 82 toward the stapler 86, so as to accommodate the recording medium 12 which moves when the nip of the pair of transport rollers 82 is open. The tray 85 aligns in a position at a terminal end portion of the recording medium 12 which moves using an abutting wall with which the terminal end of the recording medium 12 which moves comes into contact. The stapler 86 performs stapling in which the recording media 12 aligned on the tray 85 in a predetermined unit are bound together, using a staple (binding using staple (needle)).

When stapling is completed, the pair of transport rollers 82 is driven in a rotating manner by nipping the recording media 12, the recording media 12 on which stapling has been completed are discharged to the stacker 37, and the recording medium are stacked.

The stapler control unit 72 has a communication function between the printer control unit 70 and the reversal control unit 71, and controls driving of the stapler transport unit 35 (pair of transport rollers 81 and 82, guide flap 83, sensor 84, and the like), and the stapling unit 36 (stapler 86).

Ink

Subsequently, ink (ink composition) as a recording material for performing recording on the recording medium 12 will be described.

It is preferable that the ink be a water ink composition in which the main solvent of the ink is water, when considering stability, handling, and various characteristics (chromogenic property, strike-through suitability, ink reliability, or the like). In addition, strike-through suitability means a property which is suitable for suppressing a situation in which ink excessively infiltrates the recording medium 12, and strikes through.

It is preferable to use pure water, or extra pure water such as ion exchanged water, ultrafiltration water, reverse osmotic water, and distilled water, as water. In particular, it is preferable to use water which is subjected to sterilization treatment by using ultraviolet light irradiation, adding hydrogen peroxide, or the like, from the viewpoint of long preservation of ink by preventing the occurrence of mold or bacteria.

In addition, it is preferable that water of 10 weight % to 75 weight % be included in the ink composition in a viewpoint of securing an appropriate physical property (viscosity, or the like) of ink, and stability and reliability of ink.

There is ink corresponding to full color recording (image forming or printing) (for example, cyan ink, magenta ink, yellow ink, or the like), or black ink, white ink, or the like, and each of which includes a coloring material.

It is preferable that the coloring material contain at least one of a pigment, a dye, a metal oxide, or the like, in the ink of each color.

The pigment is not particularly limited; however, there is an inorganic pigment or an organic pigment for a black color, and organic pigment for each color such as a yellow color, magenta, and cyan.

As the dye, it is possible to use various dyes such as direct dye, acid dye, edible dye, basic dye, reactive dye, dispersion dye, vat dye, soluble vat dye, and reaction dispersion dye, as the dye of each color such as a yellow color, magenta, and cyan.

The ink may include a water-soluble organic solvent, polyhydric alcohols, betaine, saccharide, urea, surfactant, or the like, in addition to the coloring material in order to obtain a predetermined ink property. The predetermined ink property is a wetting property or a permeation property of ink into the recording medium 12, curling, cockling suitability, strike-through suitability with respect to the recording medium 12, clogging suitability in ejection of ink, suitability of a viscosity property depending on the temperature of ink, or the like.

Specifically, for example, it is possible to use 1,2-alkanediol, glycol ether, a pyrrolidone derivative, or the like, as the water soluble organic solvent, and use glycerin, 1,2,6-hexantriol, diethylene glycol, triethylene glycol, tetraethylene glycol, dipropylene glycol, or the like, as polyhydric alcohols. It is possible to use well-known fluorochemical surfactants, acetylene glycol-based surfactants, silicon-based surfactants, or the like, as the surfactant.

When containing a pigment in ink, a dispersing agent for dispersing the pigment may be added as a component other than that. In addition, a pH conditioner, a complexing agent, an antifoaming agent, an antioxidant, ultraviolet rays absorbent, a preservative, an antifungal agent may be added to the ink in order to further improve the characteristics of the ink.

Deformation of Recording Medium

When including a fiber for absorbing moisture such as cellulose in the recording medium 12, there is a case in which the recording medium 12 deforms due to water contained in ink. In particular, in a case of recording in which water-based ink containing water of 50 weight % or more is used, there is a case in which the deformation becomes remarkable.

Hereinafter, among deformation of the recording medium 12, deformation in which the recording medium 12 is curled in a protrusion shape or a recessed shape will be described.

FIGS. 5 to 8 are schematic views which illustrate examples of a curled state of the recording medium 12.

Figure 5:
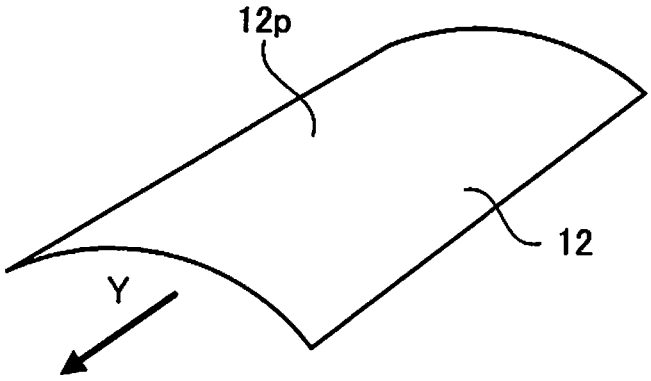
FIG. 5 is a schematic view which illustrates an example of a curled state of a recording medium.
Figure 6:
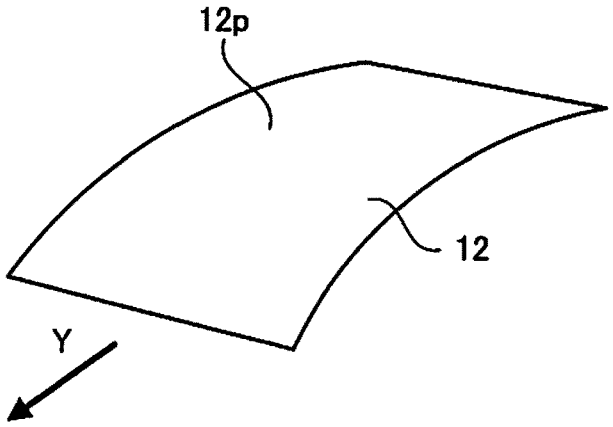
FIG. 6 is a schematic view which illustrates an example of a curled state of a recording medium.

As illustrated in FIG. 5, when applying ink to the main surface 12*p* of the recording medium 12, there is a case in which water contained in the ink infiltrates into the main surface 12*p*, the main surface 12*p* side swells (fiber which configures recording medium 12 extends), and the recording medium 12 is curled in a protrusion shape on the main surface 12*p* side. A direction in which the recording medium 12 is curled in the protrusion shape (direction of the arc) with respect to the transport direction Y is different depending on a configuration specification of the recording medium 12 (printing sheet) or a direction in which the recording medium 12 is set to the printer 100, and for example, there is also a case of being curled as illustrated in FIG. 6.

Figure 7:
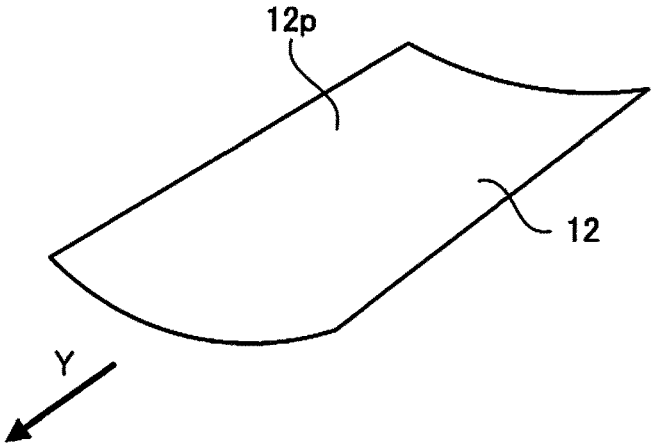
FIG. 7 is a schematic view which illustrates an example of a curled state of a recording medium.
Figure 8:
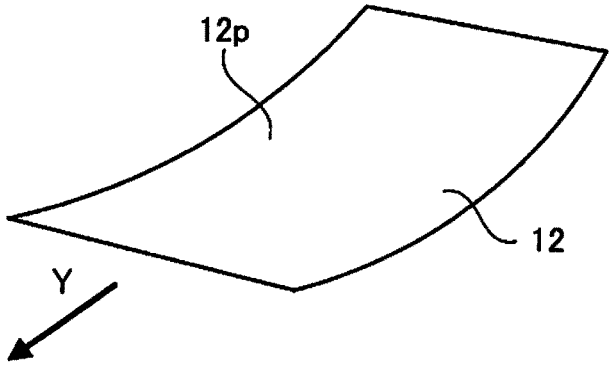
FIG. 8 is a schematic view which illustrates an example of a curled state of a recording medium.

There is a case in which a degree of such curling becomes low when extended fiber contracts along with drying of the main surface 12*p*. In addition, as illustrated in FIGS. 7 and 8, there is also a case in which fiber further contracts due to drying, and the recording medium is curled backwards (secondary curling).

A degree of such curling (amount of deformation) is different depending on various factors. As the various factors, for example, there are a material or a thickness of the recording medium 12, a configuration specification of a layer in a case in which the recording medium 12 is formed of a plurality of layers, a use environment (temperature and humidity) of the printer 100, a recording time or a lapsed time (drying time) from the recording, water content of the recording medium 12 at a point of recording start time or a point of drying start time, a specification of ink (content of water, density, temperature), an applying amount of ink, a shape and a size of an ink applying region, or the like. An amount of curling, and an amount of secondary curling become different depending on these specifications or degrees.

There is a case in which the recording apparatus 1 is not normally operated depending on such deformation (curling) of the recording medium 12. Specifically, for example, there is a case in which jamming of the recording medium 12 occurs on a transport path after recording, it is not possible to stack the recording medium in an aligned manner in a place of stacking the recording medium 12 such as the tray 85, the stacker 37, or the like, and as a result, the recording medium 12 is laid above another, or it is not possible to perform stapling in a predetermined unit.

In contrast to this, there is a device provided with a unit for suppressing deformation (curling) of the recording medium 12, like the post-processing device described in JP-A-2015-107840 which is described above, for example. However, there is a case in which the suppressing unit does not fully function when a degree of deformation (curling) of the recording medium 12 is different. For example, in the post-processing device in JP-A-2015-107840, in a case in which a pressing force using second airflow which blows in a direction which goes toward a sheet mounting face from above the sheet mounting face is not sufficient for stress of a curled sheet, it is not possible to sufficiently suppress the curling.

In contrast to this, the post-processing device in the embodiment (reversal device 210, stapling device 220) is provided with the post-processing unit (reversal transport path 18, stapling unit 36) which performs post-processing of the recording medium 12 on which recording is performed, the transport path (reversal transport path 18, stapler transport path 19) through which the recording medium 12 is transported, or the deformation suppressing unit which suppresses deformation of the recording medium 12 in the mounting unit (tray 85, stacker 37) on which the recording medium 12 is mounted, in which the deformation suppressing unit is controlled based on a predetermined parameter related to recording processing with respect to the recording medium 12. That is, suppressing intensity of the deformation suppressing unit which suppresses deformation of the recording medium 12 is controlled based on a predetermined parameter related to recording processing with respect to the recording medium 12.

Hereinafter, specific descriptions will be made.

Deformation Suppressing Unit

The deformation suppressing unit which suppresses curling can be configured in various forms on the transport path (reversal transport path 18, stapler transport path 19), or in the mounting unit (tray 85, stacker 37).

FIGS. 9 to 18 are schematic views which illustrate examples of the deformation suppressing unit.

Deformation Suppressing Unit Using Wind Pressure

Figure 9:
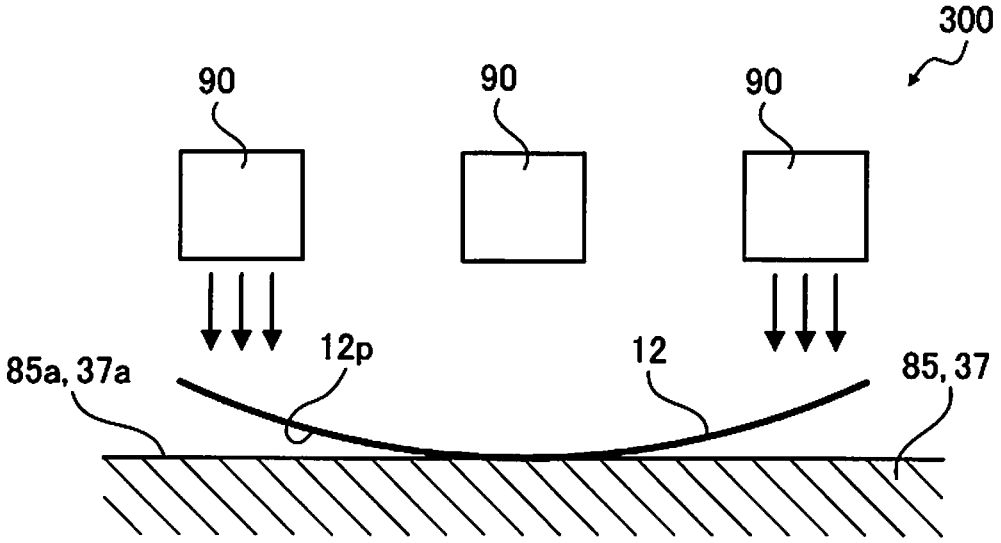
FIG. 9 is a schematic view which illustrates an example of a deformation suppressing unit which suppresses deformation of a recording medium using a wind pressure.

FIG. 9 illustrates an example of a deformation suppressing unit 300 in which deformation of the recording medium 12 mounted on the tray 85 (refer to FIG. 4) is suppressed using wind pressure. That is, the deformation suppressing unit 300 is a deformation suppressing unit in which wind pressure is used as means for pressing which resists stress due to deformation of the recording medium 12.

The deformation suppressing unit 300 is provided with a plurality of air blowers 90 (three in the example illustrated in FIG. 9). The respective air blowers 90 are provided so as to blow air in a direction of going toward a mounting face 85*a* from a position which faces the mounting face 85*a* of the tray 85 on which the recording medium 12 is mounted.

A position in the horizontal direction at which the air blower 90 is provided (in-plane position parallel to mounting face 85*a*) is set to an appropriate position in which the recording medium 12 is pressed, and curling thereof is suppressed. That is, since a position (region) of the recording medium 12 which is separated from the mounting face 85*a* by being curled is grasped in advance, in a case in which a size, an orientation or a direction of curling of the recording medium 12 is constant, the air blower is provided at an appropriate position (position at which it is possible to effectively press recording medium 12 separated from mounting face 85*a* to mounting face 85*a* using wind pressure) which faces the position. In addition, in a case in which a size, an orientation or a direction of curling of the recording medium 12 which is treated by the recording apparatus 1 is not constant, it is preferable to configure a position of providing the air blower 90 in the horizontal direction (in-plane direction) to be variable.

In the air blower 90, for example, it is possible to use a so-called air-blowing fan which blows air using a rotating blade which is driven in a rotating manner.

For example, the recording medium 12 which is curled when the main surface 12*p* on which ink is applied swells is reversed, using the reversal device 210, and as illustrated in FIG. 9, the recording medium is mounted on the mounting face 85*a* of the tray 85 in a recessed state, by placing the main surface 12*p* on which ink is applied down (direction which goes toward mounting face 85*a*). It is possible to suppress curling of the recording medium 12 when the air blower 90 presses regions on both sides of the recording medium 12 which is separated from the mounting face 85*a* by being curled.

Figure 10:
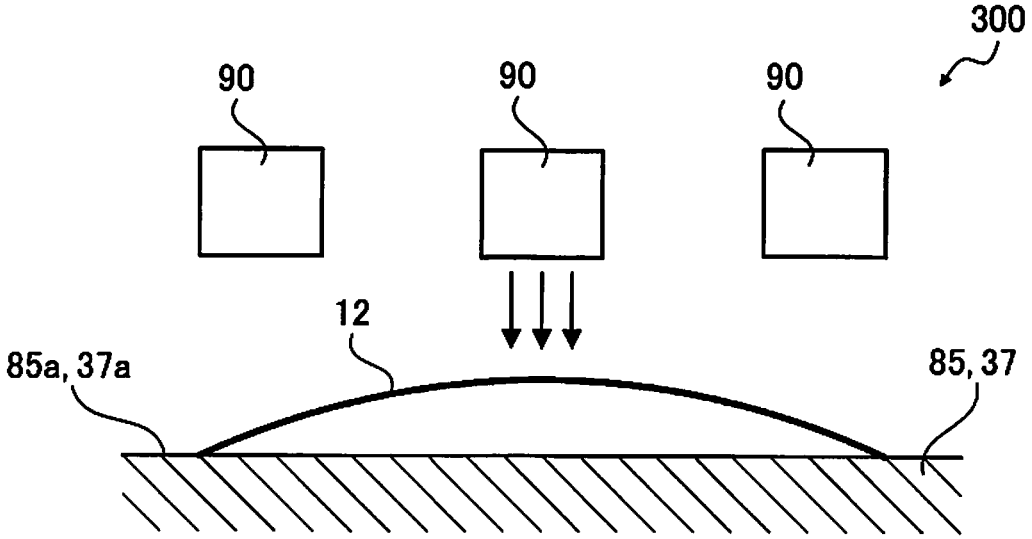
FIG. 10 is a schematic view which illustrates an example of a deformation suppressing unit which suppresses deformation of a recording medium using wind pressure.

In a case in which a curled direction of the recording medium 12 is opposite to the above described case, as illustrated in FIG. 10, it is possible to suppress curling of the recording medium 12 when the air blower 90 presses a center region of the recording medium 12 which is separated from the mounting face 85*a* by being curled.

Suppressing intensity of the deformation suppressing unit in the example is the pressure of wind which is blown by the air blower 90, and for example, a rotating speed of the rotating blade. Pressure of wind which is blown by the air blower 90 is controlled by the stapler control unit 72 which is linked with the printer control unit 70. Controlling of the suppressing intensity will be described later.

The deformation suppressing unit 300 may be provided in the stacker 37 (refer to FIG. 4). That is, the air blower 90 may be provided so as to blow air in a direction which goes toward a mounting face 37*a* from a position which faces the mounting face 37*a* of the stacker 37 on which the recording medium 12 is mounted. In this case, the deformation suppressing unit is configured as a deformation suppressing unit which suppresses curling of a case in which the recording medium 12 which is stapled and bound, is stacked by being curled.

Deformation Suppressing Unit Using Pressing

Figure 11:
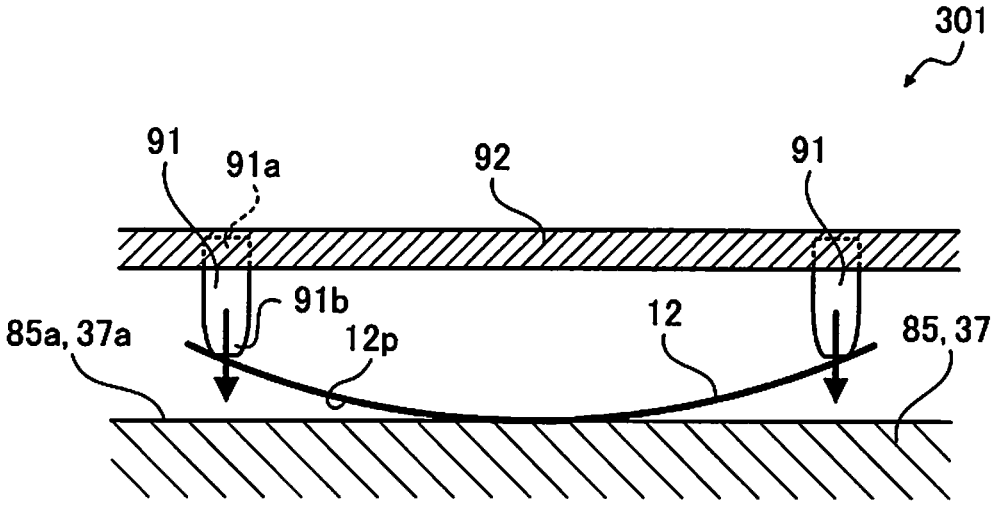
FIG. 11 is a schematic view which illustrates an example of a deformation suppressing unit which suppresses deformation of a recording medium by pressing a recording medium.
Figure 12:
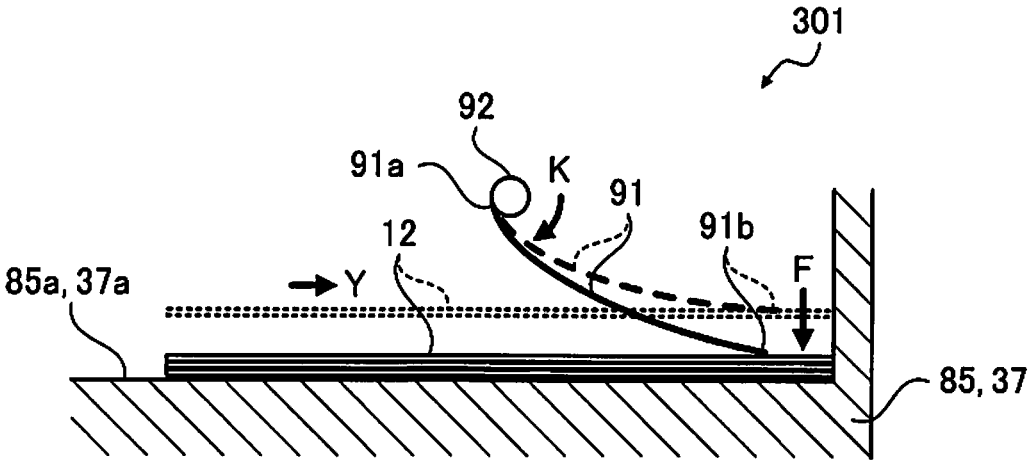
FIG. 12 is a schematic view which illustrates an example of a deformation suppressing unit which suppresses deformation of a recording medium by pressing a recording medium.

FIGS. 11 and 12 illustrate examples of a deformation suppressing unit 301 which suppresses deformation of the recording medium 12 mounted on the tray 85, by pressing the recording medium 12 by being in contact with the recording medium. That is, the deformation suppressing unit 301 is a deformation suppressing unit in which a pressing unit which resists stress due to deformation of the recording medium 12 is used.

FIG. 12 is a schematic view which describes the deformation suppressing unit 301 illustrated in FIG. 11 from a side face. In addition, one recording medium 12 is illustrated in FIG. 11, and a plurality of recording media 12 which are mounted in a stacking manner are described in FIG. 12.

The deformation suppressing unit 301 is provided with a plurality of (two in the example illustrated in FIG. 11) pressure members 91, and a guide shaft 92 which supports the pressure member 91.

The pressure member 91 is a flexible thin plate-shaped resin member, and is configured so that one end portion region 91*a* thereof is supported by the guide shaft 92, and the other end portion region 91*b* comes into contact with the recording medium 12 as a free end.

The guide shaft 92 is attached to the stapling device 220 so as to extend in parallel to the mounting face 85*a* of the tray 85 on which the recording medium 12 is mounted. By rotating the guide shaft 92 around a shaft, as denoted by an arrow K illustrated in FIG. 12, it is possible to adjust pressure F of the pressure member 91 which presses the recording medium 12.

A position in the horizontal direction at which the pressure member 91 is provided (position at which guide shaft 92 is provided and position in direction which goes toward guide shaft 92) is set to an appropriate position for pressing the recording medium 12, and suppressing curling thereof. That is, since the position (region) of the recording medium 12 which is separated from the mounting face 85*a* by being curled is grasped in advance, in a case in which a size, an orientation or a direction of curling of the recording medium 12 is constant, the pressure member is provided at an appropriate position (position at which it is possible to effectively press the recording medium 12 separated from mounting face 85*a* to mounting face 85*a*) which faces the position. In a case in which a size, an orientation or a direction of curling of the recording medium 12 which is treated by the recording apparatus 1 is not constant, it is preferable to configure a position of providing the pressure member 91 in the horizontal direction (in-plane direction) to be variable.

For example, the recording medium 12 which is curled when the main surface 12*p* on which ink is applied swells is reversed, using the reversal device 210, and as illustrated in FIG. 11, the recording medium is mounted on the mounting face 85*a* of the tray 85 in a recessed state, by placing the main surface 12*p* on which ink is applied down (direction which goes toward mounting face 85*a*). It is possible to suppress curling of the recording medium 12 when the pressure member 91 presses regions on both sides of the recording medium 12 which is separated from the mounting face 85*a* by being curled.

Suppressing intensity of the deformation suppressing unit in the example is pressure F which performs pressing, using the pressure member 91, and for example, a rotation angle of the guide shaft 92. The pressure F which performs pressing, using the pressure member 91 is controlled by the stapler control unit 72 which is linked with the printer control unit 70. Controlling of suppressing intensity will be described later.

The deformation suppressing unit 301 may be provided in the stacker 37. That is, the guide shaft 92 may be attached to the stacker 37 so as to extend in parallel to the mounting face 37*a* of the stacker 37 on which the recording medium 12 is mounted, and the pressure member 91 may be provided so as to perform pressing in a direction which goes toward the mounting face 37*a*. In this case, the deformation suppressing unit 301 is configured as a deformation suppressing unit which suppresses curling of a case in which the recording medium 12 which is stapled and bound is stacked by being curled.

Deformation Suppressing Unit Using Gravity

Figure 13:
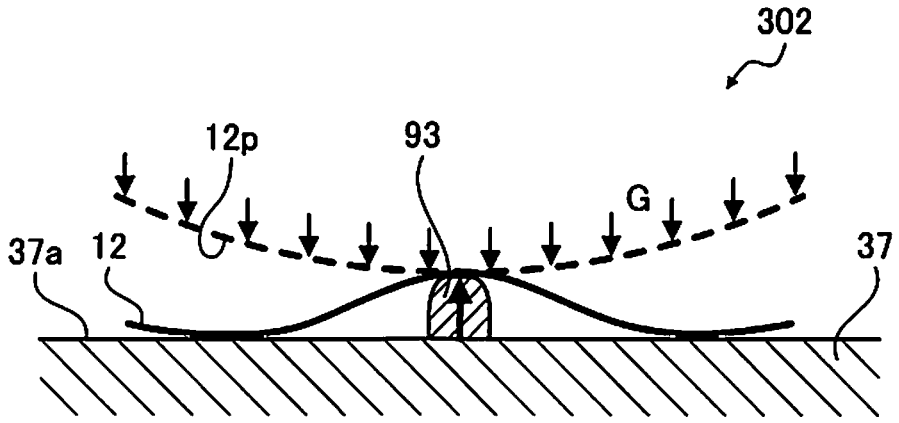
FIG. 13 is a schematic view which illustrates an example of a deformation suppressing unit which suppresses deformation of a recording medium using its own weight (gravity).
Figure 14:
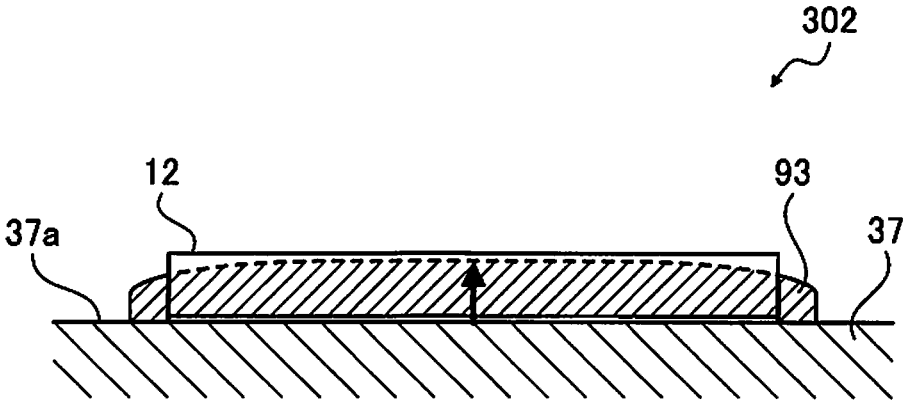
FIG. 14 is a schematic view which describes the deformation suppressing unit illustrated in FIG. 13 from a side face.
Figure 15:
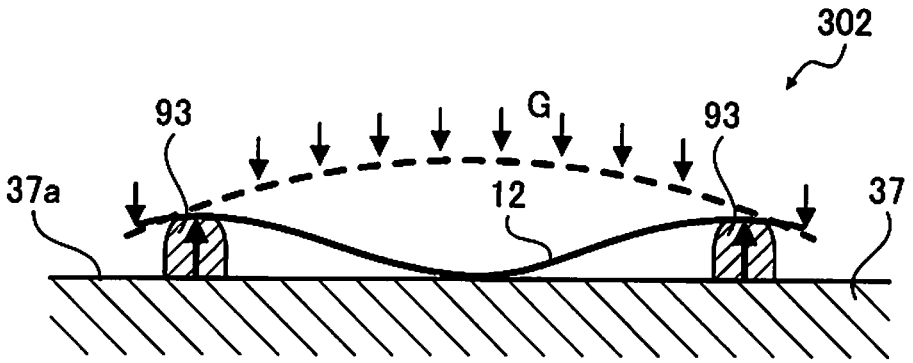
FIG. 15 is a schematic view which illustrates an example of a deformation suppressing unit which suppresses deformation of a recording medium using its own weight (gravity).

FIGS. 13 to 15 illustrate an example of a deformation suppressing unit 302 which is provided with a protruding rib which comes into contact with the curled recording medium 12 so that the recording medium is deformed in a direction opposite to the curled direction due to its own weight (gravity), and is corrected. That is, the deformation suppressing unit 302 is a deformation suppressing unit in which gravity is used as means for pressing which resists stress due to deformation of the recording medium 12.

In addition, FIG. 14 is a schematic view which describes the deformation suppressing unit 302 illustrated in FIG. 13 from a side face.

The deformation suppressing unit 302 is provided with one or a plurality of (two in the example illustrated in FIG. 15) protruding ribs 93 which are provided in the stacker 37, and protrude from the mounting face 37*a* of the stacker 37.

The protruding rib 93 is a block body which extends in a direction intersecting a direction of an arc of curling of the recording medium 12, and can cause a top face which comes into contact with the recording medium 12 using a protruding mechanism (not illustrated) provided in the deformation suppressing unit 302 to protrude in a normal line direction thereof from the mounting face 37*a*.

A position in the horizontal direction at which the protruding rib 93 is provided is set to an appropriate position at which curling of the recording medium 12 is suppressed due to its own weight (gravity G). That is, since the position (region) of the recording medium 12 which is separated from the mounting face 37*a* by being curled is grasped in advance, in a case in which a size, an orientation or a direction of curling of the recording medium 12 is constant, the protruding rib is provided at an appropriate position which is a fulcrum in which the position (region) is pressed by gravity G. In a case in which a size, an orientation or a direction of curling of the recording medium 12 is not constant, it is preferable to configure so that a position in the horizontal direction (in-plane direction) at which the protruding rib 93 is provided is variable.

For example, the recording medium 12 which is curled when the main surface 12*p* on which ink is applied swells is reversed, using the reversal device 210, and as denoted by a dashed line in FIG. 13, the recording medium is mounted on the protruding rib 93 which protrudes from the mounting face 37*a* of the stacker 37 in a recessed state, by placing the main surface 12*p* on which ink is applied down (direction which goes toward mounting face 37*a*). Curling of the recording medium 12 is corrected when regions on both sides of the recording medium 12 separated from the mounting face 37*a* by being curled receive gravity G, using the protruding rib 93 as a fulcrum. Alternatively, the gravity G works in a direction in which curling is corrected.

For example, as illustrated in FIG. 15, in a case in which a direction of curling of the recording medium 12 is opposite to the above described case, it is possible to correct curling of the recording medium 12, when the protruding rib 93 supports regions on both sides of the recording medium 12 which are close to the mounting face 37*a* as a fulcrum so that a center region of the recording medium 12 which is separated from the mounting face 37*a* by being curled receives gravity G. Alternatively, gravity G works in a direction in which curling is corrected.

Suppressing intensity of the deformation suppressing unit in the example is a degree in which a top face of the protruding rib 93 (face with which recording medium 12 comes into contact) protrudes in a normal line direction thereof, from the mounting face 37*a*, and a control amount of the protruding mechanism. The protruding mechanism is controlled by the stapler control unit 72 which is linked with the printer control unit 70. Controlling of the suppressing intensity will be described later.

Deformation Suppressing Unit Using Humidification (Applying of Water)

Figure 16:
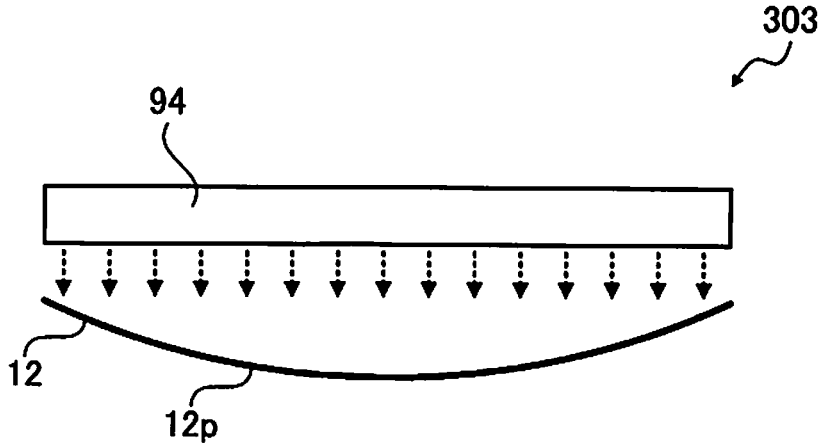
FIG. 16 is a schematic view which illustrates an example of a deformation suppressing unit which suppresses deformation of a recording medium by adding humidity (applying water).

FIG. 16 illustrates an example of a deformation suppressing unit 303 in which curling of the recording medium 12 is suppressed, using humidification (applying of water). The deformation suppressing unit 303 is a deformation suppressing unit in which a humidification (applying of water) unit is used as means for relieving stress which causes deformation of the recording medium 12.

As described above, the recording medium 12 is curled due to an operation of water contained in ink which is applied to the main surface 12*p*. Accordingly, it is possible to suppress curling of the recording medium 12 by applying water of the same amount as water filtrated into the main surface 12*p* to the rear surface of the main surface 12*p*. That is, the inside and outside are balanced, and curling is suppressed, when water with which the same amount of swelling as that of the main surface 12*p* occurs is applied to the rear surface.

The deformation suppressing unit 303 is provided with a humidification unit 94 which can apply water to the rear surface of the recording medium 12.

Specifically, the humidification unit 94 can be configured of a line head which ejects water instead of ink, for example. Accordingly, the position at which the deformation suppressing unit 303 is provided can be set to any one of positions of a transport path through which the recording medium 12 on which recording is performed is transported (reversal transport path 18, stapler transport path 19), and the mounting unit on which the recording medium 12 is mounted (tray 85, stacker 37), when the position is a position through which the recording medium 12 passes, and at which the humidification unit 94 which ejects water to the rear surface of the recording medium 12 can be provided.

Suppressing intensity of the deformation suppressing unit in the example is an amount of water applied to the rear surface of the recording medium 12 using the humidification unit 94. The amount of water applied by the humidification unit 94 is controlled by any one of the reversal control unit 71 and the stapler control unit 72 which are linked with the printer control unit 70, depending on the position at which the humidification unit 94 is provided. Controlling of the suppressing intensity will be described later.

Deformation Suppressing Unit Using Correctional Deformation

Figure 17:
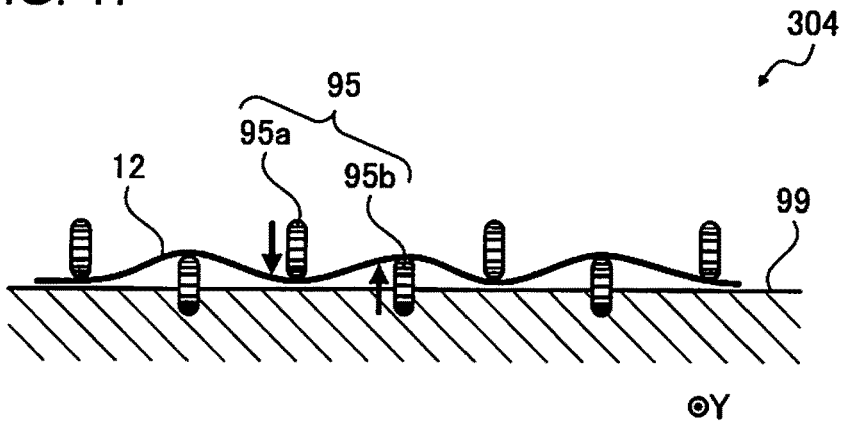
FIG. 17 is a schematic view which illustrates an example of a deformation suppressing unit which suppresses deformation of a recording medium by performing correctional deformation.

FIG. 17 illustrates an example of a deformation suppressing unit 304 in which curling of the recording medium 12 is suppressed by performing correctional deformation of the recording medium 12. That is, the deformation suppressing unit 304 is a deformation suppressing unit provided with a correction unit which corrects deformation of the recording medium 12.

For example, in a case in which curling illustrated in FIG. 6 occurs, that is, when an arc formed by curling faces the transport direction Y, there is a case in which curling can be suppressed by adding deformation which extends in the transport direction Y to the recording medium 12. As an extreme case, when bending the recording medium 12 so that a fold is generated in the transport direction Y (that is, direction of arc formed by curling) with respect to curling illustrated in FIG. 6, the curling is suppressed, and it is understood that curling is suppressed.

The deformation suppressing unit 304 is provided with a plurality of (seven in the example illustrated in FIG. 17) rollers 95 which form deformation extending in a direction of arcs formed by curling on the recording medium 12 along with a transport, at positions on any one of the transport paths (reversal transport path 18, stapler transport path 19) through which the recording medium 12 on which recording is performed is transported. The rollers 95 are driven by a transport motor (not illustrated).

As illustrated in FIG. 17, the rollers 95 are disposed at approximately equal intervals in a direction intersecting the transport direction Y, and rollers 95 which are adjacent to each other are alternately disposed by shifting in the vertical direction (thickness direction of recording medium 12) so that the recording medium 12 is interposed therebetween. It is possible to perform correctional deformation so that the recording medium 12 has a surface wave, by configuring so that the recording medium 12 is interposed between a roller 95*a* which is upwardly shifted and a roller 95*b* which is shifted downwardly in an abutting manner, and a height of the downwardly shifted roller 95*b* which comes into contact with the recording medium 12 becomes higher than a height of the upwardly shifted roller 95*a* which comes into contact with the recording medium 12. By performing such correctional deformation, it is possible to suppress curling illustrated in FIG. 6.

Suppressing intensity of the deformation suppressing unit in the example is an amount of shifting the roller 95 in the vertical direction (thickness direction of recording medium 12), and is an amount of gap between a lower end of the upwardly shifted roller 95*a* and a higher end of the downwardly shifted roller 95*b*. The larger the amount of gap, the larger the surface wave formed by the correctional deformation, and an effect of suppressing curling increases.

Deformation Suppressing Unit Using Drying

Figure 18:
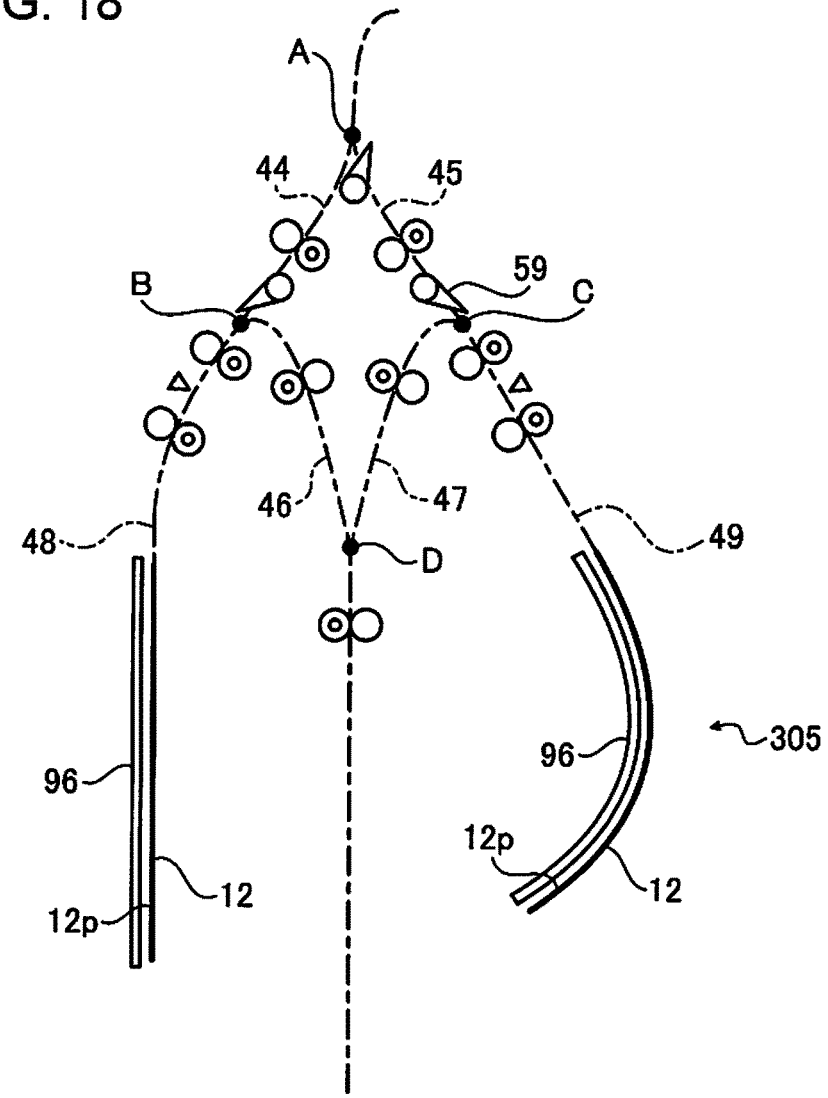
FIG. 18 is a schematic view which illustrates an example of a deformation suppressing unit which suppresses deformation of a recording medium by drying the recording medium.

FIG. 18 illustrates an example of a deformation suppressing unit 305 which suppresses curling of the recording medium 12 using drying. That is, the deformation suppressing unit 305 is a deformation suppressing unit provided with a drying unit as means for relieving stress which causes deformation of the recording medium 12.

The deformation suppressing unit 305 is provided with a heater 96 which can dry ink (water) applied to the recording medium 12.

The heater 96 is provided on a first reversal path 48 and a second reversal path 49, dries the recording medium 12 transported to the first reversal path 48 and the second reversal path 49 by heating the recording medium, and suppresses curling by contracting the main surface 12*p* which is swelled due to ink (water) applied to the main surface 12*p* of the recording medium 12. The heater 96 can be configured of an infrared light lamp, a heating wire, or the like.

The transport path provided in the heater 96 may be configured linearly and flatly, like the first reversal path 48 illustrated in FIG. 18, or may be bent, like the second reversal path 49 illustrated in FIG. 18. It is preferable to configure a bending direction so as to be opposite to a bending direction of curling of the recording medium 12.

In addition, it may be a configuration in which a plurality of transport paths with bends which correspond to various curling directions of the recording medium 12, and can set a direction in which the curling is suppressed to be opposite, are configured on the transport path with the heater 96, and a control of transporting the recording medium 12 to a corresponding transport path is performed.

Suppressing intensity of the deformation suppressing unit in the example is an output of the heater 96 or a drying time on the transport path with the heater 96. The output of the heater 96 or the drying time is controlled by the reversal control unit 71 which is linked with the printer control unit 70. Controlling of the suppressing intensity will be described later.

It was described that the heater 96 is provided in the deformation suppressing unit 305; however, the heater also includes a function as the intermediate processing unit which performs drying processing as intermediate processing of the recording medium 12 on which recording is performed.

In the above descriptions, deformation of the recording medium 12 has been described using an example of simple curling; however, there also is a case of causing more complicated deformation. For example, there is a case of complicated deformation depending on a specification of an image to be recorded on the recording medium 12. The reason for this is that an amount of ink (that is, amount of infiltrated water) applied to the main surface 12*p* of the recording medium 12 is different in a plane depending on a specification of an image.

Figure 19:
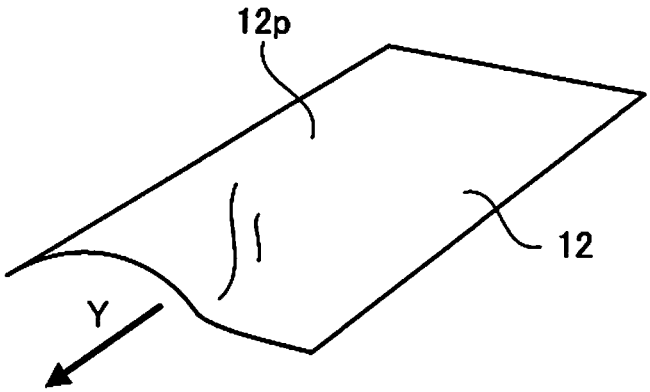
FIG. 19 is a schematic view which illustrates a state in which a part of region of a recording medium is intensively curled.

Therefore, it is preferable that the deformation suppressing unit has a configuration in which it is possible to suppress deformation with in-plane dispersion. For example, as illustrated in FIG. 19, in a case in which an image is intensively formed (applying of ink) in a part of region of the recording medium 12, and curling occurs only in the region, it is preferable to have a configuration in which deformation can be suppressed by setting the region to a target. In a case of performing an operation of suppressing the same deformation with respect to a region which is not deformed, there is a case of adversely deforming the region depending on a deformation suppressing unit, and this is to prevent such a situation.

Figure 20:
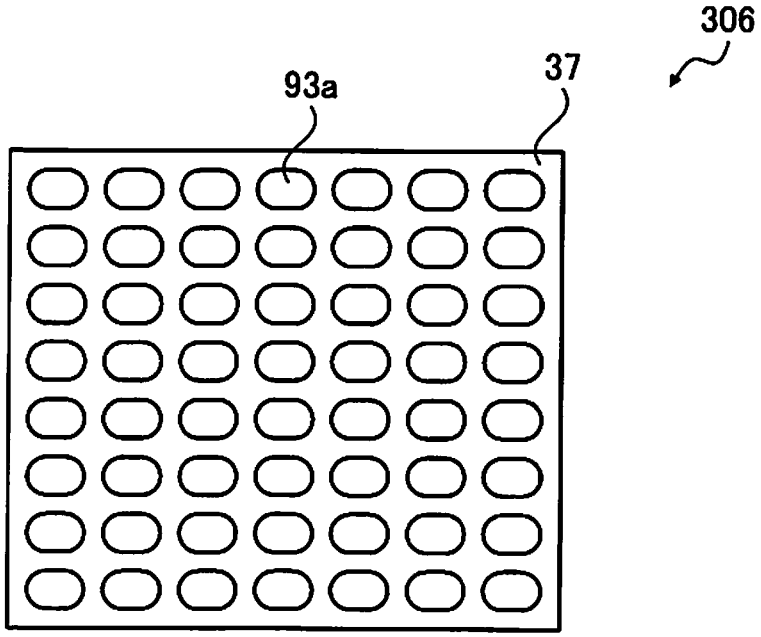
FIG. 20 is a schematic view of a deformation suppressing unit in which deformation of a recording medium which is partially deformed can be suppressed.

FIG. 20 is an example of a deformation suppressing unit 306 with a configuration in which it is possible to suppress deformation by setting a partially deformed region of the recording medium 12 to a target.

The deformation suppressing unit 306 illustrated in FIG. 20 is a modification example of the deformation suppressing unit 302 with the protruding rib described with reference to FIGS. 13 to 15, and in which a state of an arrangement of the protruding ribs 93 provided in the stacker 37 is planarly viewed.

As illustrated in FIG. 20, the deformation suppressing unit 306 is provided with the plurality of (fifty six in the example illustrated in FIG. 20) protruding ribs 93*a* which are disposed in a matrix on the mounting face 37*a* of the stacker 37.

Since the protruding ribs 93*a* are disposed in a matrix, in contrast to the protruding rib 93 provided in the deformation suppressing unit 302 which was a block body long-extended in a direction intersecting a direction of the arc of curling of the recording medium 12, by causing a protruding rib 93*a* at a position (position at which deformation can be corrected) corresponding to a deformation formed in a specific region of the recording medium 12 to protrude, it is possible to cause the protruding rib 93*a* to suppress deformation in the region.

In this manner, it is possible to configure a deformation suppressing unit which can similarly suppress deformation formed in a specific region of the recording medium 12, by disposing an operation unit which suppresses deformation of the recording medium 12 in a matrix, and causing thereof to face the recording medium 12, without being limited to the protruding rib 93*a*. For example, as the operation unit disposed in a matrix, a configuration in which the air blower 90 of the deformation suppressing unit 300 described with reference to FIG. 9 disposed in a matrix, may be adopted.

In the deformation suppressing unit 303 described in FIG. 16, since it is possible to control the position of applying water, similarly to forming of an image on the recording medium 12, in a case of configuring the humidification unit 94 using a line head which ejects water, for example, when applying water so as to form a mirror image on the rear surface thereof according to an image to be recorded on the recording medium 12, it enters a state of being balanced, and it is possible to suppress deformation such as curling. That is, the deformation suppressing unit 303 is configured as a deformation suppressing unit which can suppress deformation formed in a specific region of the recording medium 12.

Controlling of Deformation Suppressing Unit

Subsequently, controlling of the deformation suppressing unit which characterizes the embodiment will be described.

As described above, it is preferable to keep a balance between a degree of deformation and an operational effect of a deformation suppressing unit (suppressing intensity) when suppressing deformation of the recording medium 12. For example, in a case in which an operation of a deformation suppressing unit with respect to stress of the curled recording medium 12 is not sufficient, it is not possible to fully suppress curling, and solve the problem from the beginning, and in contrast to this, when evenly driving a deformation suppressing unit using sufficient suppressing intensity which can cope with all of the deformation which can be assumed, it may lead to energy consumption, or adversely deform the recording medium 12.

In the embodiment, suppressing intensity or a suppressing specification of a deformation suppressing unit is controlled so as to cope with a degree or a deformed state of the recording medium 12. Specifically, suppressing intensity or a suppressing specification of a deformation suppressing unit is controlled based on a parameter (parameter related to recording processing with respect to recording medium 12) which determines a degree of deformation of the recording medium 12. In addition, the suppressing specification is a specification of suppressing intensity including a portion (in-plane position of recording medium 12) to which suppressing intensity is applied, and means suppressing intensity, locally.

Predetermined Parameter Related to Recording Processing

In a predetermined parameter related to recording processing, which determines a degree of deformation of the recording medium 12, physical property information of the recording medium 12, composition data of ink, information on recording environment for performing recording on the recording medium 12, recording data for performing recording on the recording medium 12, a lapsed time after performing recording on the recording medium 12, a transport path (printer transport path 17, reversal transport path 18, stapler transport path 19), or information on device environment in which the mounting unit (tray 85, stacker 37) is included, are included.

It is not essential to include all of the above described parameters in the predetermined parameter related to the recording processing. For example, it is not necessary to include a parameter which is assumed to be a parameter which does not influence a degree of deformation of the recording medium 12 such as a case in which a recording medium 12 or ink to be used is limited to one type in advance, a case in which the environment for performing recording on the recording medium 12 is limited to a specific environment, or the like, as a parameter for controlling suppressing intensity, or a specification for suppressing of the deformation suppressing unit.

Physical property information of the recording medium 12 is physical property information related to deformation of the recording medium 12, and is prepared as data which is evaluated in advance.

The data (physical property information related to deformation of recording medium 12) which is evaluated and prepared in advance can be prepared as an amount of deformation of a test piece in a predetermined elapsed time or deformation stress obtained when pressing a deformed portion, by applying water with predetermined density with respect to a predetermined test piece (recording medium 12) under a predetermined environment (under predetermined temperature and humidity), for example.

In addition, the physical property information may be information on a product number of the recording medium 12 which is linked with the physical property information which is obtained after being evaluated in advance, or a material name which configures the recording medium 12 linked with the physical property information which is obtained after being evaluated in advance.

Composition data of ink is information on content of water or a volatile component contained in ink. In particular, in a case of water-based ink containing water of 50 weight % or more, a degree of deformation of the recording medium 12 becomes remarkably different depending on content of water. In addition, in a case in which ink containing water of 70 weight % or more, there is a high frequency of causing secondary curling in a case in which the recording medium 12 is dried.

Information on the recording environment in which recording is performed on the recording medium 12 is a temperature and a humidity of a place in which the printer 100 is provided, for example.

There is a case in which infiltration speed or drying speed of ink (water) applied to the recording medium 12 differs in an environment in which a temperature and humidity are different, and as a result, deformation characteristics of the recording medium 12 (degree of deformation, or state and change thereof) are changed. In addition, since water content (degree of drying) of the recording medium 12 placed in the environment in which a temperature and humidity is different is changed, similarly, there is a case in which infiltration speed or drying speed of ink (water) applied to the recording medium 12 is changed.

As described above, recording data for performing recording on the recording medium 12 is data for causing the printer 100 to execute recording, which is generated based on image data (text data or image data) to be recorded on the recording medium 12. That is, since an amount of ink (water) applied to the recording medium 12, density to be applied (duty), or a region to be applied is changed due to the recording data, a degree of deformation of the recording medium 12, or a state of deformation becomes different depending on the recording data. For example, in a case in which the recording medium 12 is a general recording sheet configured of cellulose, mainly, when a difference in duty inside and outside of the recording medium 12 is 30% or more, curling becomes remarkable. In addition, control information on whether recording on the recording medium 12 is double-sided recording or single-sided recording is also included in the recording data. Since there is a remarkable difference in duty inside and outside of the recording medium 12 in single-sided recording, curling becomes remarkable. For example, in a case in which water content in one face in the recording medium is higher than the other face, the face with the larger water content is in a protrusion shape.

For example, in a case of determining which face of a recording medium will be in a protrusion shape with respect to the mounting unit (tray 85, stacker 37) based on a difference in amount of moisture of the recording medium, and considering suppressing of a recording medium using wind pressure, it is preferable to perform a control as follows.

That is, it is possible to perform an optimal control based on recording data, for example, it is controlled so as to blow air using the air blower 90 disposed at the center, in a case in which a difference in moisture inside and outside of a recording medium is 30% or more, and a case in which a face of a recording medium with large moisture does not face the mounting unit, it is controlled so as to blow air using an air blower 90 other than the air blower 90 disposed at the center, in a case in which a difference in moisture inside and outside of a recording medium is 30% or more, and a case in which the face of a recording medium with large moisture faces the mounting unit, and does not blow air, in a case in which a difference in moisture inside and outside of a recording medium is less than 30%.

Here, "duty" is a value calculated in the following expression.

duty[%]=the actual number of recorded dots/(vertical resolution×horizontal resolution)×100

In the expression, "the actual number of recorded dots" is the actual number of recorded dots per unit area which is formed by using ink droplets, and the "vertical resolution" and the "horizontal resolution" are resolutions per unit area, respectively.

A lapsed time after performing recording on the recording medium 12 is a natural drying time of the recording medium 12 on which recording is performed, in other words.

When the recording medium 12 on which recording is performed dries while moving along the transport path, a degree or a state of deformation becomes different. In addition, for example, in a case in which the recording apparatus 1 stops due to an error such as an occurrence of jamming of the recording medium 12 on the transport path of the recording apparatus 1, a degree or a state of deformation is changed when natural drying of the recording medium 12 proceeds.

Information on the device environment of an environment in which the transport path (printer transport path 17, reversal transport path 18, stapler transport path 19) or the mounting unit is included, is for example, a temperature and a humidity of a place in which the post-processing device 200 (reversal device 210, stapling device 220) is provided.

There is a case in which filtration speed or drying speed of ink (water) applied to the recording medium 12 is changed in an environment in which temperature and humidity are different on the transport path or the mounting unit of the recording medium 12, and as a result, deformation characteristics of the recording medium 12 are changed.

Controlling of Suppressing Intensity

Suppressing intensity of the respective above described deformation suppressing units is controlled based on the above described predetermined parameter. Specifically, for example, suppressing intensity is controlled by a condition table (or, function) from which suppressing intensity of the respective deformation suppressing units is derived, corresponding to a specific value of the above described predetermined parameter.

The condition table (or, function) is prepared as a condition table (or, function) from which suppressing intensity is derived depending on the density of water (duty) to be applied, or the temperature and humidity, for example, in each type of the recording medium 12 and each type of the deformation suppressing unit, for example, after performing a sufficient evaluation in advance.

The prepared condition table (or, function) is stored in a storage unit which is provided in the printer control unit 70.

Deriving of suppressing intensity using the condition table (or, function) is performed in the printer control unit 70. In the condition table (or, function), in a case in which a well-known recording sheet is used as the recording medium 12, for example, a condition table (or, function) corresponding to a deformation suppressing unit provided in the recording apparatus 1 is extracted from a plurality of condition tables which are stored in the storage unit provided in the printer control unit 70, by designating a name of the recording sheet (for example, product number) in the printer control unit 70. The printer control unit 70 uses the condition table (or, function) and derives suppressing intensity using recording data for performing recording, or the temperature and humidity at that point in time. The temperature and humidity may be obtained from a thermometer and a hygrometer provided in each unit of the recording apparatus 1, or may be input to the printer control unit 70 by an operator of the recording apparatus 1.

The printer control unit 70 controls a corresponding deformation suppressing unit by being linked with the control unit (reversal control unit 71, stapler control unit 72) provided with the deformation suppressing unit based on derived suppressing intensity.

As described above, according to the post-processing device and the recording apparatus in the embodiment, it is possible to obtain the following effects.

A degree of deformation (amount of deformation or stress due to deformation) of the recording medium 12 on which recording is performed is not constant, and is different depending on various parameters related to recording processing with respect to the recording medium 12. According to the embodiment, since a deformation suppressing unit is controlled based on a predetermined parameter related to recording processing with respect to the recording medium 12, it is possible to further appropriately suppress deformation of the recording medium 12.

Since water-based ink having a high affinity to the recording medium 12 infiltrates into the recording medium 12 in recording in which water-based ink is used, a degree of deformation of the recording medium 12 is high after recording or drying, compared to a recording in which oil-based ink is used. According to the embodiment, it is possible to perform post-processing with respect to the recording medium 12 on which recording is performed using water-based ink, in a state in which deformation of the recording medium 12 is further effectively suppressed.

In a case in which recording is performed on the recording medium 12 including fiber which absorbs moisture such as cellulose using water-based ink containing water of 50 weight % or more, it is possible to further appropriately suppress deformation of the recording medium 12.

According to the embodiment, since suppressing intensity of a deformation suppressing unit which suppresses deformation of the recording medium 12 based on a predetermined parameter in which physical property information of the recording medium 12 is included, it is possible to further appropriately suppress deformation of the recording medium 12. For example, it is possible to suppress deformation using suppressing intensity which is strong, and necessary and sufficient with respect to a recording medium 12 which is curled with strong stress.

According to the embodiment, since suppressing intensity of a deformation suppressing unit which suppresses deformation of the recording medium 12 is controlled based on a predetermined parameter in which information on the recording environment in which recording is performed on the recording medium 12 is included, it is possible to further appropriately suppress deformation of the recording medium 12. For example, in a case in which water content of the recording medium 12 is high such as a case in which recording is performed by the printer 100 provided in the environment with a high humidity, it is possible to suppress deformation using suppressing intensity which is necessary and sufficient, and is weak, since a degree of deformation is low compared to a case of performing recording on a recording medium 12 which is dried.

According to the embodiment, since suppressing intensity of a deformation suppressing unit which suppresses deformation of the recording medium 12 is controlled based on a predetermined parameter in which recording data for performing recording on the recording medium 12 is included, it is possible to further appropriately suppress deformation of the recording medium 12. For example, in a case in which a difference in duty inside and outside of the recording medium 12 is remarkable, such as single-sided recording for example, deformation is suppressed using strong, and necessary and sufficient suppressing intensity, since a degree of curling is high.

According to the embodiment, since suppressing intensity of a deformation suppressing unit which suppresses deformation of the recording medium 12 is controlled based on a predetermined parameter in which a lapsed time after performing recording on the recording medium 12 is included, it is possible to further appropriately suppress deformation of the recording medium 12. For example, in a case in which it is assumed that secondary curling remarkably occurs when a lapsed time is over, for example, deformation is suppressed in the direction of suppressing secondary curling using necessary and sufficient suppressing intensity, according to the lapsed time.

According to the embodiment, since suppressing intensity of a deformation suppressing unit which suppresses deformation of the recording medium 12 is controlled based on a predetermined parameter in which information on the device environment of an environment in which the transport path or the mounting unit is included, it is possible to further appropriately suppress deformation of the recording medium 12. For example, in a case in which a temperature is high, and a humidity is low in the environment in which the transport path is included, progression of drying of the recording medium 12 is high during transport, and in a case in which it is assumed that a degree of curling is high, deformation is suppressed using suppressing intensity which is strong, and necessary and sufficient.

The post-processing device 200 is provided with the reversal transport path 18 as an intermediate processing unit which performs reversal processing as the intermediate processing, and a stapling unit 36 which performs stapling as the finishing treatment, as the post-processing unit. For this reason, it is possible to perform reversal processing and stapling in the same device. According to the embodiment, since deformation of the recording medium 12 is further appropriately suppressed, an occurrence of a failure such as jamming is suppressed in the device which performs the processing.

Deformation of the recording medium 12 is suppressed by any one of the deformation suppressing units of the pressing unit which resists stress due to deformation, the correction unit which corrects deformation, and a relieving unit of stress which causes deformation, and since respective suppressing intensity is controlled based on a predetermined parameter related to recording processing with respect to the recording medium 12, it is possible to further appropriately suppress deformation of the recording medium 12.

According to the recording apparatus 1, it is possible to perform recording which is subjected to post-processing, in a state in which deformation after recording of the recording medium 12 is further appropriately suppressed.

The entire disclosure of Japanese Patent Application No. 2016-138256, filed on Jul. 13, 2016 is expressly incorporated by reference herein.

What is claimed is:

1. A post-processing device comprising:

a post-processing unit which performs post-processing of a recording medium on which recording is performed by using water-based ink;

a mounting unit on which the recording medium to be subjected to post-processing in the post-processing unit is mounted;

a deformation suppressing unit which suppresses deformation of the recording medium caused by a predetermined parameter related to recording processing with respect to the recording medium, in the mounting unit, the predetermined parameter being physical property information of the recording medium, information on recording environment in which recording is performed on the recording medium, or a lapsed time after performing recording on the recording medium; and a control unit which controls the deformation suppressing unit, wherein the control unit receives the predetermined parameter in cooperation with a recording unit-control unit that controls the recording processing, and changes suppressing intensity of the deformation suppressing unit relative to the recording medium based on the predetermined parameter, and wherein information related to recording data for performing recording on the recording medium is included in the predetermined parameter.

2. The post-processing device according to claim 1, wherein the deformation suppressing unit suppresses deformation of the recording medium using wind pressure.

3. The post-processing device according to claim 2, wherein the water-based ink contains water of 50 weight % or more, and includes a water soluble organic solvent, surfactant, and pigment.

4. The post-processing device according to claim 2, wherein the deformation suppressing unit includes three air blowers which face a mounting face, wherein the three air blowers are disposed in line in a direction orthogonal to a direction in which a medium to be subjected to post-processing in the post-processing unit is discharged to the mounting unit, wherein one air blower among the three air blowers is disposed at a center of the mounting unit with respect to the orthogonal direction, and is disposed by being interposed between other air blowers with respect to the orthogonal direction, and wherein the control unit controls the air blowers which are operated, according to a difference in moisture between the inside and outside of the recording medium, and the surface of the recording medium which faces the mounting unit.

5. The post-processing device according to claim 4, wherein the control unit controls the air blower which is disposed at the center to blow air in a case in which the difference in moisture between the inside and outside is a predetermined value or more, and a case in which the surface of the recording medium with large moisture does not face the mounting unit, wherein the control unit controls the other air blowers to blow air in a case in which the difference in moisture between the inside and outside is a predetermined value or more, and a case in which the surface of the recording medium with large moisture faces the mounting unit, and wherein the control unit controls the air blowers so as not to blow air in a case in which the difference in moisture between the inside and outside is less than a predetermined value.

6. The post-processing device according to claim 1, further comprising:

an intermediate processing unit which performs intermediate processing, and a finishing unit which performs a finishing treatment as the post-processing unit, wherein the intermediate processing unit performs reversal processing or drying processing of the recording medium as the intermediate processing, and wherein the finishing unit performs stapling, punching, or sorting as the finishing treatment with respect to the plurality of recording media on which the intermediate processing is completed.

7. The post-processing device according to claim 1, wherein the deformation suppressing unit suppresses deformation of a plurality of recording mediums that are being mounted on the mounting unit and include the recording medium, and the deformation suppressing unit is arranged so as to overlap the mounting unit as viewed in a direction in which the plurality of recording mediums are stacked each other on the mounting unit.

8. The post-processing device according to claim 1, further comprises a pair of rollers that discharges the recording medium on which the post-processing has been performed to the mounting unit.

9. The post-processing device according to claim 1, wherein the suppressing unit includes a humidification unit that humidifies the recording medium to suppress the deformation of the recording medium.

10. A recording apparatus comprising:

a recording head which performs recording by applying water-based ink to a recording medium;

a recording head-control unit that controls recording processing;

a post-processing unit which performs post-processing of the recording medium on which recording is performed;

a mounting unit on which the recording medium to be subjected to post-processing in the post-processing unit is mounted;

a deformation suppressing unit which suppresses deformation of the recording medium caused by a predetermined parameter related to the recording processing with respect to the recording medium, in the mounting unit, the predetermined parameter being physical property information of the recording medium, information on recording environment in which recording is performed on the recording medium, or a lapsed time after performing recording on the recording medium; and a control unit which controls the deformation suppressing unit, wherein the control unit receives the predetermined parameter in cooperation with the recording head-control unit, and changes suppressing intensity of the deformation suppressing unit relative to the recording medium based on the predetermined parameter, and wherein information related to recording data for performing recording on the recording medium is included in the predetermined parameter.

* * * * *